US007234445B2

(12) United States Patent
Spickermann et al.

(10) Patent No.: US 7,234,445 B2
(45) Date of Patent: Jun. 26, 2007

(54) DEVICE FOR ACTUATING A THROTTLE VALVE OF AN INTERNAL COMBUSTION ENGINE

(75) Inventors: Martin Spickermann, Finsing (DE); Berndt Roehrig, Puchheim (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 11/344,164

(22) Filed: Feb. 1, 2006

(65) Prior Publication Data

US 2006/0185645 A1 Aug. 24, 2006

Related U.S. Application Data

(63) Continuation of application No. PCT/EP2004/007491, filed on Jul. 8, 2004.

(30) Foreign Application Priority Data

Aug. 5, 2003 (DE) ..... 103 35 700

(51) Int. Cl.
*F02D 11/04* (2006.01)

(52) U.S. Cl. ..... 123/396; 123/398; 123/400

(58) Field of Classification Search ..... 123/361, 123/396, 398, 399, 400
See application file for complete search history.

(56) References Cited

U.S. PATENT DOCUMENTS 4,559,912 A * 12/1985 Larom et al. ..... 123/396
4,879,657 A 11/1989 Tamura et al.
4,944,268 A * 7/1990 Wilde ..... 123/400
5,065,722 A * 11/1991 Huber et al. ..... 123/400
5,141,070 A * 8/1992 Hickmann et al. ..... 123/396
5,467,751 A 11/1995 Kumagai
5,829,409 A 11/1998 Saito et al.
6,295,967 B1 * 10/2001 Weber et al. ..... 123/399
6,666,187 B2 * 12/2003 Dahlberg et al. ..... 123/396
6,705,286 B1 * 3/2004 Light et al. ..... 123/396
2006/0130809 A1 * 6/2006 Wetor et al. ..... 123/396

FOREIGN PATENT DOCUMENTS

DE 37 11 779 A1 10/1988
DE 40 11 182 A1 10/1991

OTHER PUBLICATIONS

International Search Report dated Oct. 21, 2004.

* cited by examiner

*Primary Examiner*—Erick Solis
(74) *Attorney, Agent, or Firm*—Crowell & Moring LLP

(57) ABSTRACT

A device for actuating at least one throttle valve of an internal combustion engine is provided. When the throttle valve opening angles are small, the throttle valve and the actuating device are positively coupled, and when the throttle valve opening angles are large, the throttle valve and the actuating device are form lockingly coupled in the closing direction, but are only conditionally coupled in the opening direction, such that the throttle valve can be brought into operation for smaller throttle valve opening angles.

16 Claims, 4 Drawing Sheets

DEVICE FOR ACTUATING A THROTTLE VALVE OF AN INTERNAL COMBUSTION ENGINE

CROSS-REFERENCE TO RELATED APPLICATIONS

This application is a continuation of PCT Application No. PCT/EP2004/007491 filed on Jul. 8, 2004 which claims priority to German Application No. 103 35 700.9 filed Aug. 5, 2003.

BACKGROUND AND SUMMARY OF THE INVENTION

The invention relates to a device for actuating at least one throttle valve of an internal-combustion engine, having an actuating device, such as a throttle twist grip, a stop, which may be swiveled about an axis via the actuating device, a driving device corresponding with the stop, and a throttle valve, which may be swiveled by means of the driving device. The stop limits a movement of the throttle valve in an opening direction. The stop is acted upon by a spring in the closing direction of the throttle valve. The driving device follows the stop while being acted-upon by the spring. An adjusting device is provided for a controlled throttle valve intervention.

Actuating devices of this type permit a throttle valve intervention in the closing direction superimposed upon the driver's actuation intention. In this context, reference is made to German Patent document DE 40 11 182 A1.

For example, in the case of a motorcycle, when the throttle twist grip is operated by the driver, a swiveling of a cable pulley takes place by way of a Bowden cable, which cable pulley has a stop, which can be swiveled by means of the cable either indirectly or directly. Acted upon by spring force, the cable pulley is prestressed in the closing direction. If required, by the use of additional kinematic transmission members, the stop corresponds with a driving device and actuates a throttle valve in the opening direction, which throttle valve is arranged on a shaft.

If the throttle twist grip is not operated or is operated less, the cable pulley, while being acted upon by spring force, swivels in the closing direction into the corresponding position defined by the driver. The driving device—also while being acted upon by a spring force—following the stop.

According to a control device, a throttle valve intervention takes place as a function of a plurality of input values in that an adjusting device acts upon the throttle valve in the closing direction. In this case, the driving device lifts off the stop, so that the intervention is not noticeable on the driver side at the throttle twist grip.

Such a throttle valve intervention can take place, for example, with respect to a limiting of the maximal vehicle speed, of the internal-combustion engine torque or, for reasons of acoustics, also before the background of an optimized load cycle.

However, it was found that the uncoupling of the stop and the driving device is problematic, particularly in the lower load range. In the case of small throttle valve angles, a good apportioning capability is required, which does not exist because the driving device follows the stop only slightly because of the spring force and, particularly in the lower load range, the throttle valve is extremely loaded by low pressure.

An aspect of the invention is to cost-effectively provide an actuating device of the above-mentioned type by the use of simple devices, which actuating device is operationally reliable and permits a good apportioning of the internal-combustion engine power also in a lower load range.

This present invention meets this need by providing a device for actuating at least one throttle valve of an internal-combustion engine. The device includes an actuating device, such as a throttle twist grip, a stop, which may be swiveled about an axis by use of the actuating device, a driving device corresponding with the stop, and a throttle valve, which may be swiveled by use of the driving device. The stop limits movement of the throttle valve in the opening direction, and is acted upon by a spring in the closing direction of the throttle valve. The driving device follows the stop while being acted-upon by the spring. An adjusting device is provided for the controlled throttle valve intervention, wherein the stop and the driving device may be mutually coupled in a form-locking manner. According to the basic idea, the stop and the driving device can be formlockingly coupled with one another.

Particularly preferable embodiments and further developments of the invention are described and claimed herein.

According to a particularly preferable embodiment, a coupling of the stop and the driving device takes place as a function of the throttle valve opening angle. That is, below a predetermined throttle valve opening angle (in the case of small throttle valve opening angles), the stop and the driving device are mutually coupled and, above the predetermined throttle valve opening angle (in the case of small throttle valve opening angles), the stop and the driving device are uncoupled.

In an embodiment in which the stop is assigned to a cable pulley, which may be operated by way of a Bowden cable, the Bowden cable covers a partial circumference of the cable pulley, and the driving device is arranged to be axially spaced from the cable pulley. A lever element is expediently provided for connecting the cable pulley and the driving device. The lever element may be operated by means of the Bowden cable. If required, more than a partial circumference of the cable pulley may also be covered by the Bowden cable. It is important that the Bowden cable lifts tangentially off the cable pulley in a transition area. The driving device operates a shaft arranged coaxially with respect to the cable pulley axis.

It is very advantageous for the lever element to be assigned to the cable pulley and to be swivel able together with the latter about the cable pulley axis.

According to a particularly preferable embodiment of the invention, the lever element has a first cable-pulley side end area and a second driving-device-side end area. Expediently, the first end area of the lever element, as a function of the position of the cable pulley, is assigned to the partial circumference of the cable pulley, which is covered by the Bowden cable or is not covered by the Bowden cable.

Advantageously, in the covered partial circumference of the cable pulley, the Bowden cable acts upon the first end area of the lever element such that the lever element is operated in the engaging direction, the second end area being connected with the driving device. In the uncovered partial circumference of the cable pulley, the first end area of the lever element is released, so that the lever element is disengaged while being acted upon by spring force.

The driving device expediently has a recess corresponding with the second end area of the lever element, for the form-locking connection with the lever element.

Other objects, advantages and novel features of the present invention will become apparent from the following detailed description of the invention when considered in conjunction with the accompanying drawings.

DETAILED DESCRIPTION OF THE DRAWINGS

Figure 1:
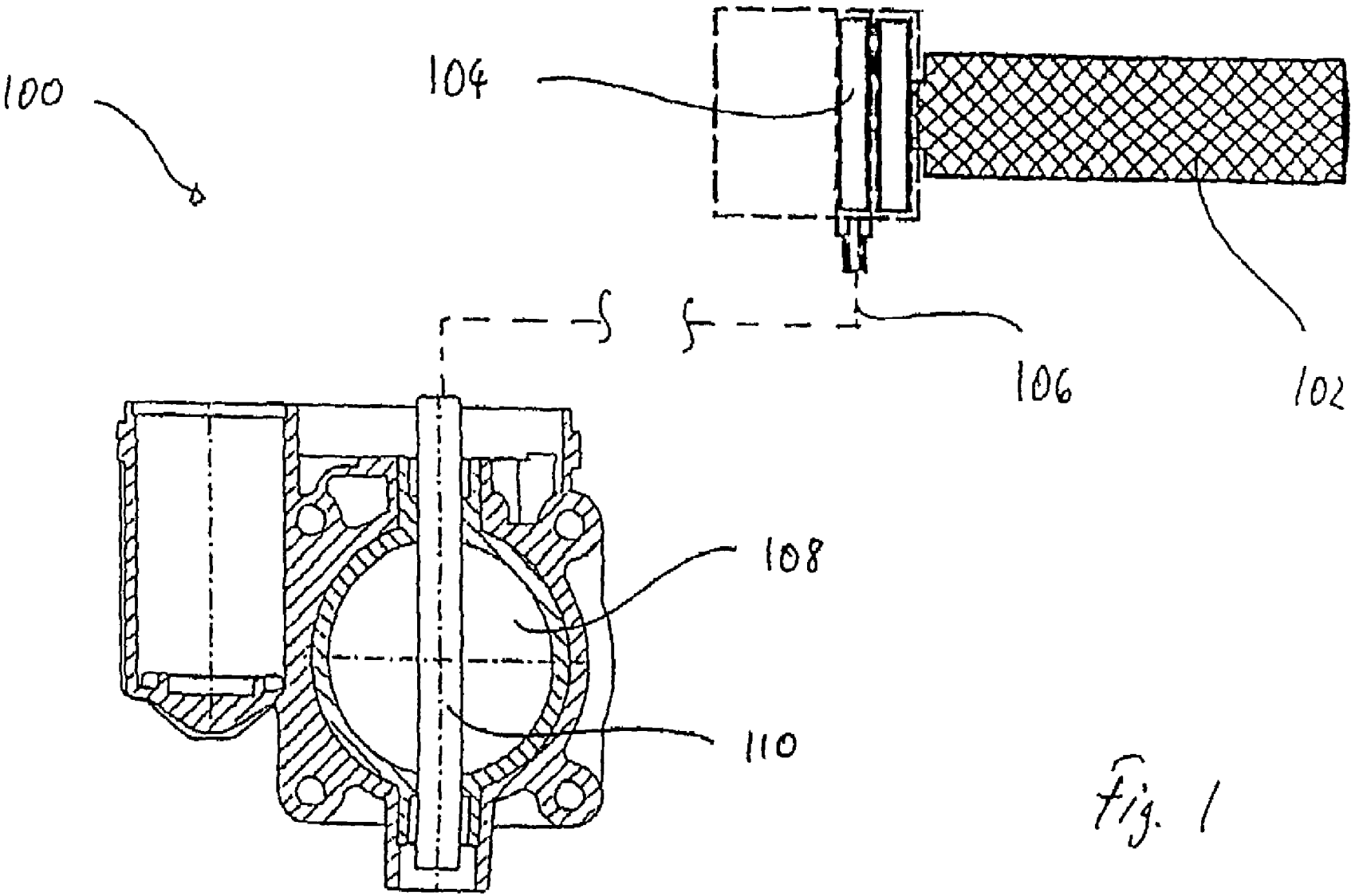
FIG. 1 is a schematic view of a throttle twist grip connected with a throttle valve of an internal-combustion engine, in the manner of an example.

FIG. 1 illustrates a device 100 for actuating a throttle valve 108 of an internal-combustion engine (not shown in detail) by way of a throttle twist grip 102. Such devices are normally found on motorcycles, in which case the throttle twist grip 102 has a pipe-section-shaped cylindrical construction and, rotatably about its longitudinal axis, is arranged at the outer end of a handlebar. In an idling position, the throttle twist grip 102, corresponding to a non-actuated position, is held against a stop while being acted upon by a restoring force. Actuation takes place by the user twisting the throttle twist grip 102 against the restoring force.

A cable pulley 104 is coaxially connected with the throttle twist grip 102, which cable pulley 104 receives the end of a Bowden cable on its circumference and may be twisted together with the throttle twist grip 102. Starting from the idling position, when the cable pulley 104 is rotated, the Bowden cable 106 is wound onto the cable pulley 104 against the restoring force and is thereby shortened. As a result, the throttle valve 108 is swiveled into the opening direction, by way of the Bowden cable 106, for example, via another cable pulley, (not shown here in detail) which is connected with the throttle valve shaft 110.

Even if, in the present case, only one throttle valve 108 is shown, analogously, naturally also arrangements with several throttle valves, for example, for several cylinders of an internal-combustion engine, are included. The throttle valve 108 is used for controlling a fuel volume flowing into the cylinder, in which case an admixing of the fuel takes place, for example, by injection into the suction pipe or directly into the combustion chamber.

Figure 2:
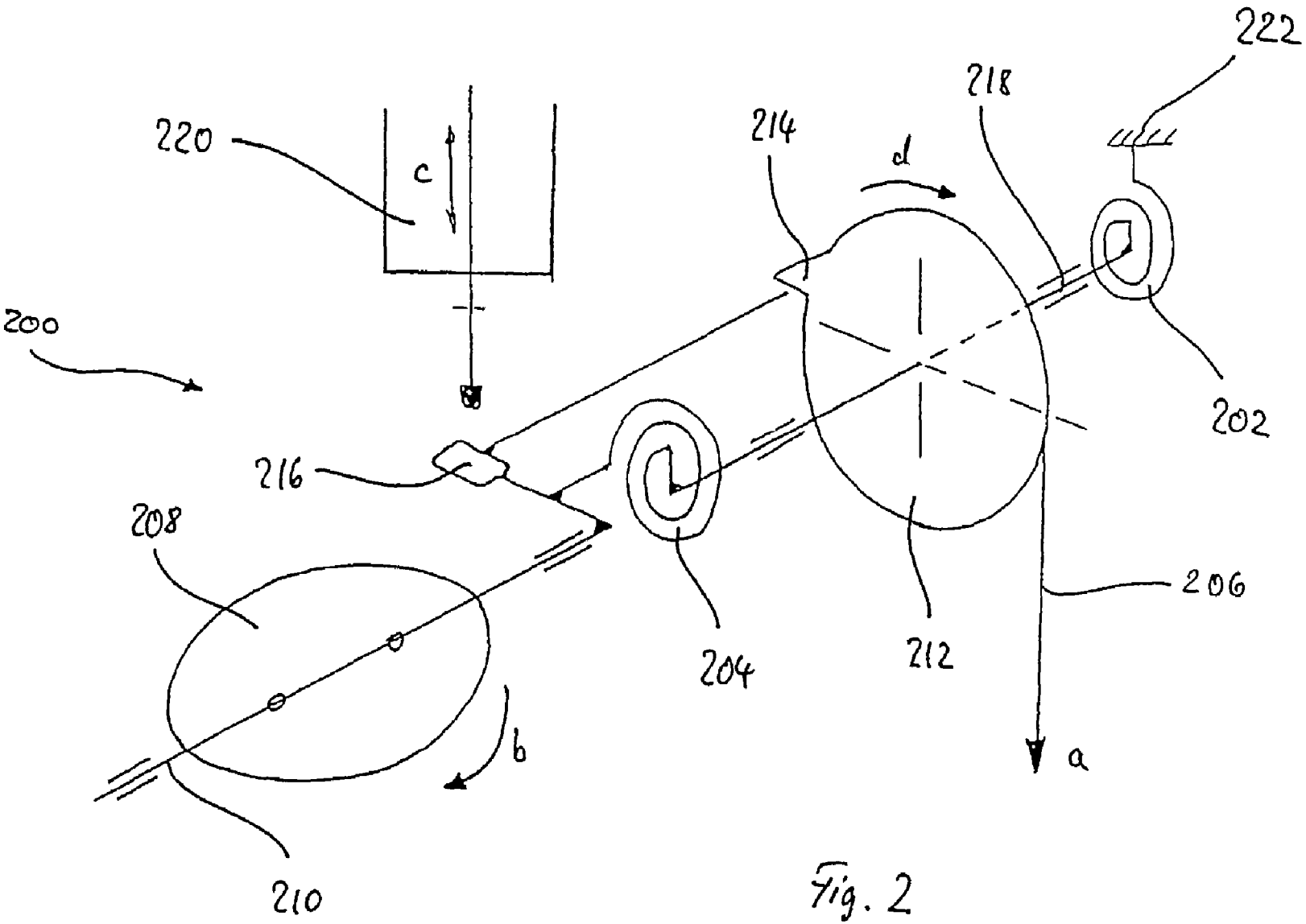
FIG. 2 is a schematic view of a device for actuating a throttle valve with a throttle valve intervention in the closing direction, in the manner of an example.

A device 200 for actuating a throttle valve 208 with a throttle valve intervention in the closing direction "b" is illustrated in FIG. 2. A swivellable cable pulley 212, which, radially spaced with respect to its axis, has a stop 214, is arranged on a shaft 218. Coaxially with respect to the shaft 218 of the cable pulley 212, a throttle valve shaft 210 is provided, which has an also swivellable throttle valve 208. The throttle valve shaft 210 has a lever element with a driving device 216, which corresponds with the stop 214.

A spring 202, which is supported on the internal-combustion engine housing 222, holds the cable pulley 212 in a prestressed condition in the throttle valve closing direction. Acted upon by the force of the spring 204, the driving device 216 is held on the stop 214. In the present embodiment, the spring 204 is, on the one side, supported on the throttle valve shaft 210 and, on the other side, on the shaft 218 of the cable pulley 212. According to another embodiment, however, the spring 204 may, for example, also be supported on the internal-combustion engine housing 222. The spring force of the spring 204 acts against that of the spring 202 and is significantly weaker.

When the device 200 is actuated, the Bowden cable 206 is pulled against the force of the spring 202 in the direction of arrow "a", the cable pulley 212 and, with it, the stop 214 being swiveled in the direction of arrow "d". As a result of the force of the spring 204, the driving device 216 follows the stop 214 and the throttle valve 208 swivels in the opening direction according to the direction of arrow "b". When the Bowden cable 206 is moved back against the direction of the arrow "a", the cable pulley 212 rotates back as a result of the force of the spring 202, the stop 214 actuates the driving device 216 and the throttle valve 208 closes.

In the throttle valve closing direction, the stop 214 and the driving device 216 cause an unconditional coupling, but in the throttle valve opening direction, only a conditional coupling—as a result of the spring 204—so that a throttle valve intervention becomes possible in the closing direction. For this purpose, an adjusting device 220 is provided, which may be controlled by a control device (not shown here in detail) on the basis of input quantities, such as the internal-combustion engine torque, the rotational speed of the internal-combustion engine, the vehicle speed, and/or the change or rate of change on the part of the actuating device (FIG. 1, 102). In the present case, the adjusting device 220 is an electromotive actuator, such as a stepping motor, but according to another embodiment, a hydraulic, pneumatic or mechanical actuator may also be used. The adjusting device 220 acts upon the driving device 216 in the direction of the arrow "c" and thus causes a throttle valve intervention such that a smaller throttle valve angle is adjusted than that defined on the part of the actuating device with respect to the cable pulley 214. In this case, the driving device 216 lifts off the stop 214 against the force of the spring 204.

Figure 3A:
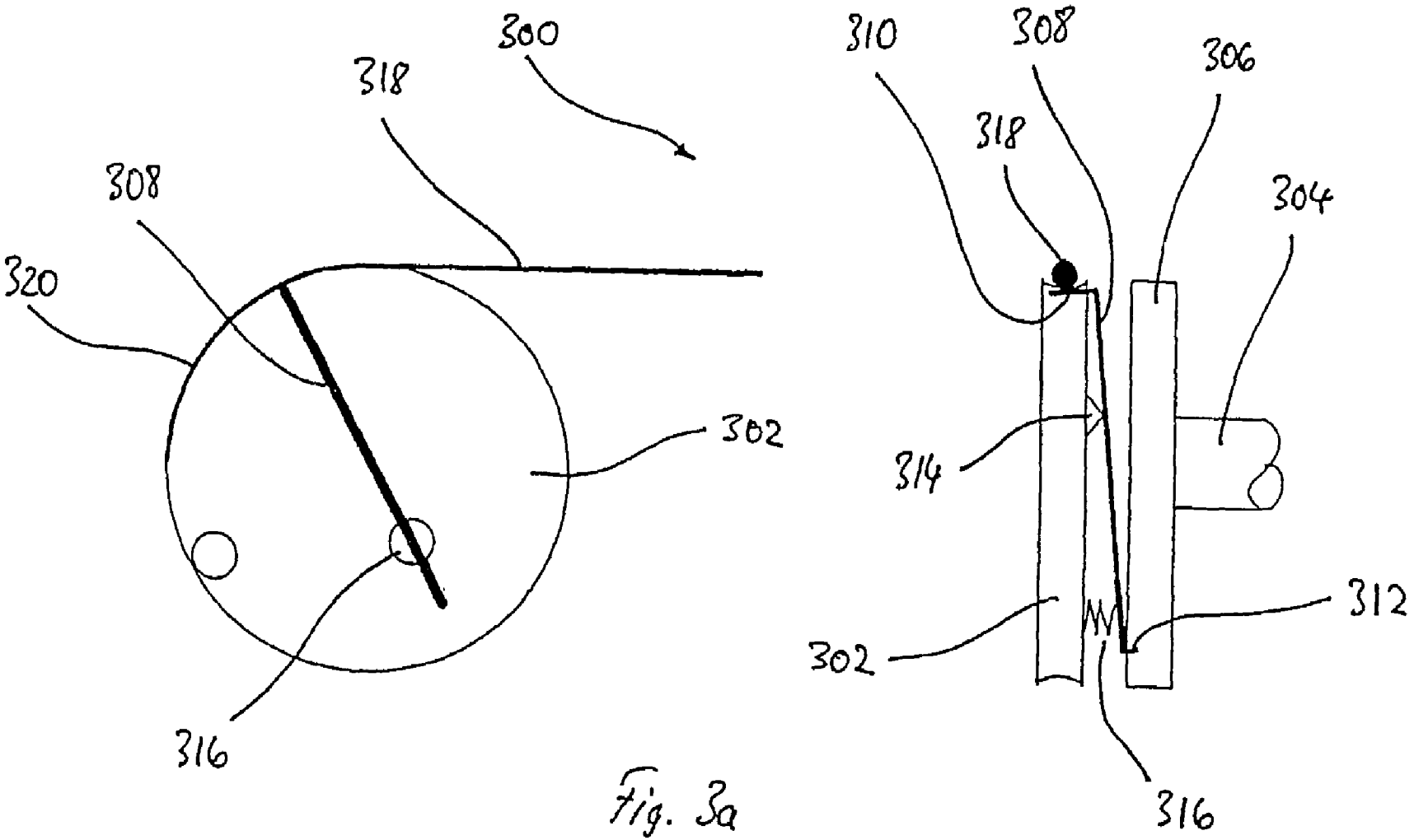
FIG. 3*a* is a schematic view of a device for coupling a cable pulley with a throttle valve shaft in an engaged position, in the manner of an example.

FIG. 3*a* shows a device 300 for coupling a cable pulley 302 with a throttle valve shaft 304 in the engaged position. The throttle valve shaft 304 is arranged to be coaxial with respect to the cable pulley 302 and, on an end side, has an axially spaced coupling pulley 306, which is parallel to the cable pulley 302. Between the cable pulley 302 and the coupling pulley 306, a connection device is provided, which is assigned to the cable pulley 302 and includes a lever 308, which may be engaged or disengaged, may be swiveled about a bearing point 314, and may be held in a prestressed manner by a spring 316 in the disengaged position.

In the area of small throttle valve opening angles, the end area 310 of the lever 308 is assigned to the area 320 of the cable pulley 203 covered by the Bowden cable 318, and the Bowden cable 318 presses the lever end 310 against the force of the spring 316 onto the circumference of the cable pulley 302. The lever swivels about the bearing point 314, so that the end area 312 of the lever 308 engages in a recess on the coupling pulley 306 and thus a form locking connection is established between the cable pulley 302 and the coupling pulley 306. A particularly good apportioning capability of the internal-combustion engine power exists despite the low force of the spring 204 (FIG. 2) also in the case of a considerable low-pressure-caused loading of the throttle valve. As an alternative, a coupling can also take place by means of other elements, such as a friction clutch, as a function of the angular position.

Figure 3B:
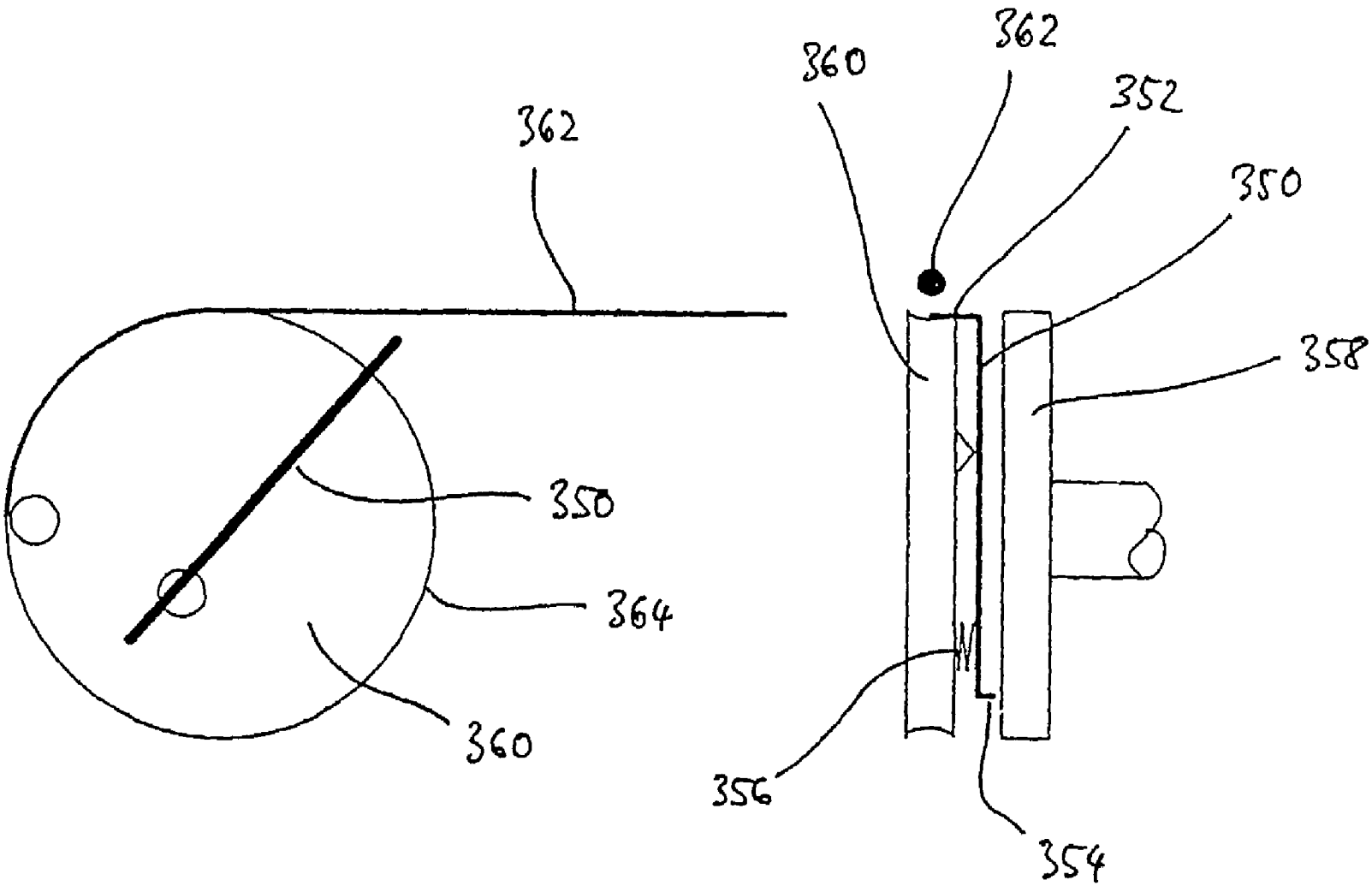
FIG. 3*b* is a schematic view of a device for coupling a cable pulley with a throttle valve shaft in a disengaged position, in the manner of an example.

During a further actuation in the direction of larger throttle valve opening angles, the condition illustrated in FIG. 3*b* will occur. Because of the further rotation of the cable pulley 360, the end area 352 of the lever 350 is now assigned to the area 364 of the cable pulley 360, which area is not covered by the Bowden cable 362. The lever end 352 is no longer acted upon by the Bowden cable 362 and is therefore free. It lifts off the circumference of the cable pulley 360 as a result of the force of the spring 356, so that the lever end disengages and releases the coupling pulley 358. A form-locking connection no longer exists between the cable pulley 360 and the coupling pulley 358.

Reference is again made to FIG. 2, which illustrates the spring 204 whose force causes the coupling pulley 358 and thus the throttle valve 208 to follow the cable pulley 360, 212 in a force-actuated manner. In this area, a throttle valve intervention can take place as described above.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for actuating at least one throttle valve of an internal-combustion engine, the device comprising:

an actuating mechanism;

a stop, which is swivellable about an axis via the actuating mechanism;

a driving device corresponding with the stop, wherein the at least one throttle valve is swivellable via the driving device;

wherein the stop limits movement of the at least one throttle valve in an opening direction, and is acted upon by a spring in a closing direction, the driving device following the stop while being acted upon by the spring;

an adjusting mechanism operatively configured to perform a controlled throttle valve intervention; and wherein the stop and the driving device are mutually coupleable in a form-locking manner.

2. The device according to claim 1, wherein the actuating mechanism is a throttle twist grip.

3. The device according to claim 1, wherein a coupling of the stop and the driving device takes place as a function of the throttle valve opening angle.

4. The device according to claim 1, wherein the stop and the driving device are coupled with one another below a predetermined throttle valve opening angle, and further wherein the stop and the driving device are uncoupled above the predetermined throttle valve opening angle.

5. The device according to claim 3, wherein the stop and the driving device are coupled with one another below a predetermined throttle vale opening angle, and further wherein the stop and the driving device are uncoupled above the predetermined throttle valve opening angle.

6. The device according to claim 1, wherein:

the stop is assigned to a cable pulley, which is actuatable by a Bowden cable, the Bowden cable covers a partial circumference of the cable pulley and, the driving device is arranged to be axially spaced with respect to the cable pulley, a lever element connects the cable pulley and the driving device, the lever element being actuated by the Bowden cable.

7. The device according to claim 6, wherein the lever element is assigned to the cable pulley and is swivellable together with the cable pulley.

8. The device according to claim 6, wherein the lever element has a first cable-pulley-side end area and a second driving-device-side end area.

9. The device according to claim 8, wherein the first end area of the lever element, as a function of a position of the cable pulley, is assigned to a partial circumference of the cable pulley, the partial circumference being either covered or uncovered by the Bowden cable.

10. The device according to claim 9, wherein in the covered partial circumference of the cable pulley, the Bowden cable acts upon the first end area of the lever element, and the lever element is actuated in the engaging direction, the second end area being connected with the driving device.

11. The device according to claim 9, wherein in the uncovered partial circumference of the cable pulley, the first end area of the lever element is released, and the lever element is disengaged while being acted upon by a spring force.

12. The device according to claim 10, wherein in the uncovered partial circumference of the cable pulley, the first end area of the lever element is released, and the lever element is disengaged while being acted upon by a spring force.

13. The device according to claim 10, wherein the driving device has a recess corresponding with the second end area of the lever element.

14. An interface for coupling an actuating mechanism with a throttle valve of an internal-combustion engine, the interface comprising:

a stop which is swivelable about an axis via the actuating mechanism, the stop limiting movement of the throttle valve in an opening direction and being acted upon by a spring biased in a closing direction;

a driving device operatively configured to correspond with the stop the driving device being spring-force biased to follow the stop, wherein the driving device is coupled to swivel the throttle valve; and wherein the stop and the driving device are unconditionally coupled in the closing direction of the throttle valve and only conditionally coupled via the spring force bias in the opening direction of the throttle valve.

15. The interface according to claim 14, wherein the coupling between the stop and the driving device take place as a function of a throttle valve opening angle.

16. The interface according to claim 15, wherein when the throttle valve opening angles are small, the stop and the driving device are positively coupled, and when the throttle valve opening angles are large, the stop and the driving device are unconditionally coupled in the closing direction but only conditionally coupled in the opening direction.

* * * * *